US007179337B2

(12) United States Patent
Suzuki et al.

(10) Patent No.: US 7,179,337 B2
(45) Date of Patent: Feb. 20, 2007

(54) METHOD FOR PRODUCING A SOFT MAGNETIC MATERIAL

(75) Inventors: Yasuyoshi Suzuki, Chiryu (JP); Yurio Nomura, Nagoya (JP); Yoshiaki Nishijima, Toyokawa (JP); Shoji Miyake, Suita (JP); Yukio Makino, Nishinomiya (JP); Teppei Satoh, Mino (JP)

(73) Assignee: Denso Corporation, Kariya (JP)

( * ) Notice: Subject to any disclaimer, the term of this patent is extended or adjusted under 35 U.S.C. 154(b) by 426 days.

(21) Appl. No.: 10/687,894

(22) Filed: Oct. 17, 2003

(65) Prior Publication Data

US 2004/0086412 A1 May 6, 2004

(30) Foreign Application Priority Data

Oct. 25, 2002 (JP) ..... 2002-310377
Sep. 4, 2003 (JP) ..... 2003-312303

(51) Int. Cl.
*H01F 1/03* (2006.01)

(52) U.S. Cl. ..... 148/105; 148/122

(58) Field of Classification Search ..... None
See application file for complete search history.

(56) References Cited

U.S. PATENT DOCUMENTS 5,302,306 A * 4/1994 Nagata et al. ..... 252/62.62
5,348,800 A * 9/1994 Moro et al. ..... 428/328

FOREIGN PATENT DOCUMENTS

JP 4-202645 7/1992
JP 5-36514 2/1993
JP 5-47541 2/1993
JP A-5-109520 4/1993
JP A-7-135106 5/1995
JP 8-264361 10/1996

OTHER PUBLICATIONS

Machine translation of Japanese Patent Document No. 05-036514.*
Japanese Office Action dated Jul. 4, 2006 in corresponding Japanese application No. 2003-312303.

* cited by examiner

*Primary Examiner*—John P. Sheehan
(74) *Attorney, Agent, or Firm*—Harness, Dickey & Pierce, PLC

(57) ABSTRACT

The invention provides a method for preparing a soft magnetic material which meets demands for low iron loss, high density, high strength and high productivity. The method comprises a surface oxidation step of forming oxide films on the surfaces of a soft magnetic powder, a step of preparing a molding compound of the soft magnetic powder by mixing a soft magnetic powder and a binder with a predetermined blending ratio, a press molding step of press-molding the molding compound of the soft magnetic powder into a predetermined shape, and a sintering step of sintering the press-molded soft magnetic powder to produce a soft magnetic material, wherein a millimeter wave sintering apparatus or a discharge plasma sintering apparatus is used as a heating means in the surface oxidation step or in the sintering step. Thereby, energy of millimeter waves or discharge plasma acts locally on oxidized surface portions having a large electric resistance of the soft magnetic powder, the surfaces of the soft magnetic powder are locally heated at a temperature near the melting point, and oxidation of the surfaces of the soft magnetic powder (formation of an oxide film) and sintering (diffusional joining between oxide films) are promoted.

20 Claims, 3 Drawing Sheets

METHOD FOR PRODUCING A SOFT MAGNETIC MATERIAL

BACKGROUND OF THE INVENTION

1. Field of the Invention

The present invention relates to a method for producing a soft magnetic material which comprises sintering a press-molded soft magnetic powder.

2. Description of the Related Art

In recent years, methods for producing a soft magnetic material which comprises sintering a press-molded soft magnetic powder for the purpose of an increase in magnetic permeability, a decrease in iron loss, and the like, of a soft magnetic material, have been studied. As shown in Japanese Unexamined Patent Publication No. 5-36514, these methods comprise first oxidizing the surfaces of an atomized alloy powder in air to form a soft magnetic Ni—Zn ferrite thin film on the surfaces of the powder, subsequently sputtering Al in a nitrogen ambient atmosphere to form an AlN base insulating film on the Ni—Zn ferrite thin film, adding a $B_2O_3$ powder to this soft magnetic powder to prepare a molding compound of a soft magnetic material, press-molding the molding compound into a predetermined shape, and then sintering the press-molded soft magnetic powder at 1,000 degrees centigrade under pressure, by hot pressing, to produce a soft magnetic material.

However, the above-mentioned method has a problem in that, when sintering the press-molded soft magnetic powder under pressure by hot pressing, the insulating film on the surface of the soft magnetic powder is cracked by the press pressure, and the insulation among soft magnetic powder particles deteriorates, and then the iron loss (eddy current loss) of the sintered soft magnetic material increases. If a thick insulating film is formed in order to prevent the insulating film from cracking, the density of a magnetic material in the soft magnetic material will deteriorate, the saturation magnetic flux density will deteriorate, and the magnetic property will worsen. Moreover, the hot press sintering has drawbacks in that the bonding strength among soft magnetic powder particles is weak and the mechanical strength of a soft magnetic material is weak. Furthermore, it has also problems that the step of forming a soft magnetic Ni—Zn ferrite thin film on the surface of an atomized alloy powder and the step of sputtering Al in a nitrogen ambient atmosphere to form an insulating film take time and effort and, then, the production cost becomes high.

SUMMARY OF THE INVENTION

The present invention has been made in consideration of such a situation. Therefore, the present invention aims at providing a method for producing a soft magnetic material which can meet demands for low iron loss, for high density, for high strength, and for productivity.

To achieve the above objects, one embodiment of the present invention is a method for producing a soft magnetic material comprising a surface oxidation step of forming an oxide film on the surface of a soft magnetic powder, a step of preparing a molding compound of the soft magnetic powder for press-molding the soft magnetic powder, a press molding step of press-molding the molding compound of the soft magnetic powder into a predetermined shape, and a sintering step of sintering the press-molded soft magnetic powder by elevating the temperature of the periphery of the oxide film up to near the melting point, using a millimeter-wave sintering apparatus or a discharge plasma sintering apparatus, to produce a soft magnetic material.

Another embodiment of the present invention is a method for producing a soft magnetic material comprising a surface oxidation step of forming an oxide film on the surface of a soft magnetic powder, a step of preparing a molding compound of the soft magnetic powder for press-molding the soft magnetic powder, a press molding and sintering step of sintering a press-molded soft magnetic powder by elevating the temperature of the periphery of the oxide film up to near the melting point using a millimeter wave sintering apparatus or a discharge plasma sintering apparatus while press-molding the molding compound of the soft magnetic powder into a predetermined shape to produce a soft magnetic material.

Another embodiment of the present invention is a method for producing a soft magnetic material comprising a surface oxidation step of forming an oxide film on the surface of a soft magnetic powder, a step of preparing a molding compound of the soft magnetic powder for press-molding the soft magnetic powder, a press molding step of press-molding the molding compound of the soft magnetic powder into a predetermined shape, and a sintering step of sintering the press-molded soft magnetic powder to produce a soft magnetic material, characterized by forming the oxide film on the surface of the soft magnetic powder by heating the surface of the soft magnetic powder in an oxidizing atmosphere using a millimeter wave sintering apparatus or a discharge plasma sintering apparatus in the surface oxidation step.

DETAILED DESCRIPTION OF THE INVENTION

Figure 1:
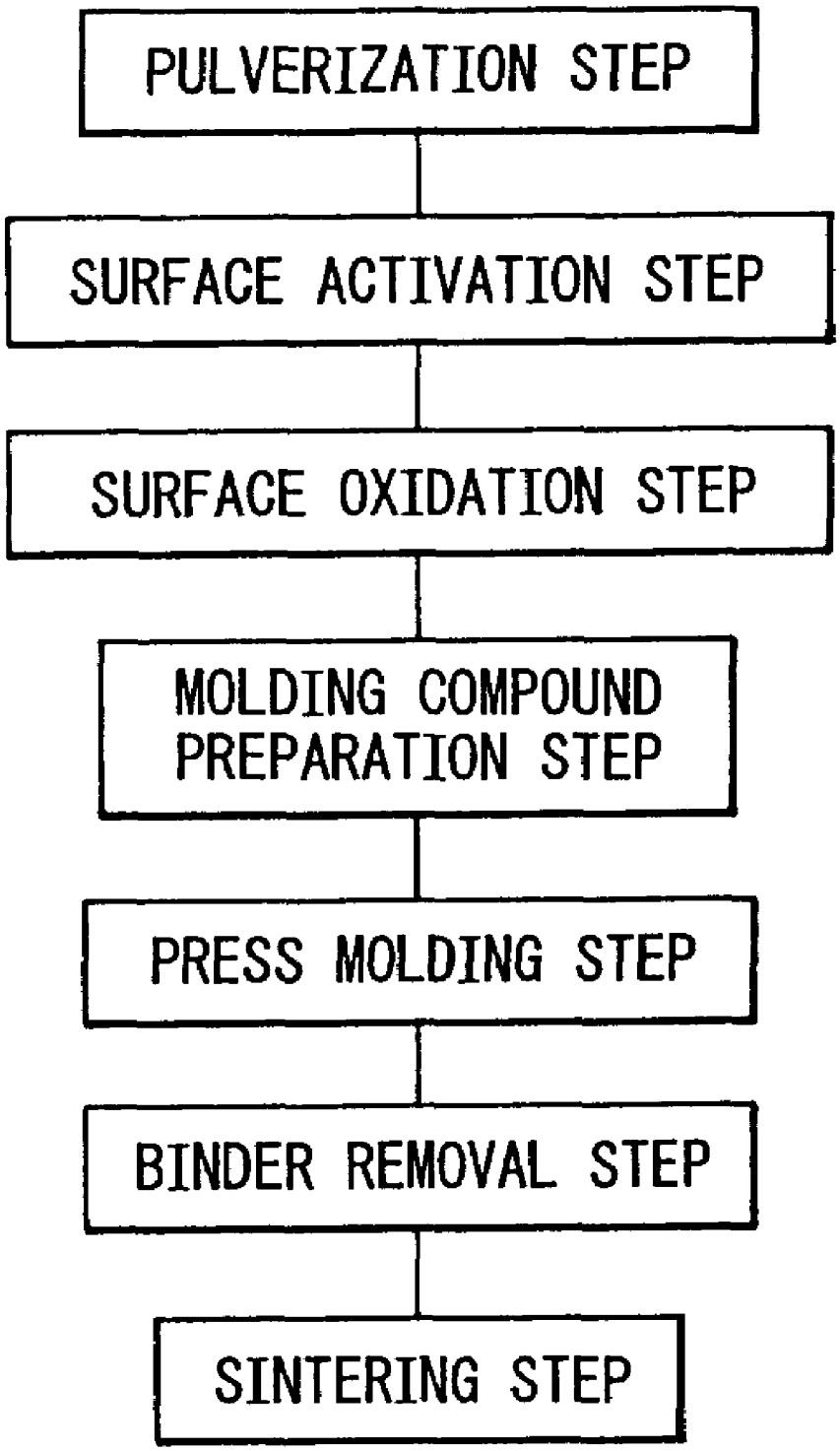
FIG. 1 is a process flow chart illustrating a production process of a soft magnetic material in Example 1 of the present invention.

In one aspect of the present invention, a method for producing a soft magnetic material comprises a surface oxidation step of forming an oxide film on the surface of a soft magnetic powder, a step of preparing a molding compound of the soft magnetic powder for press-molding the soft magnetic powder, a press molding step of press-molding the molding compound of the soft magnetic powder into a predetermined shape, and a sintering step of sintering the press-molded soft magnetic powder by elevating the temperature of the periphery of the oxide film up to near the melting point using a millimeter wave sintering apparatus or a discharge plasma sintering apparatus to produce a soft magnetic material. When a millimeter wave or discharge plasma is irradiated to the press-molded soft magnetic powder using a millimeter wave sintering apparatus or a discharge plasma sintering apparatus in the sintering step, the energy of the millimeter wave or discharge plasma acts locally on the oxide film having a large electric resistance on the surface of the soft magnetic powder. Consequently, only the periphery of the oxide film on the surface of the soft magnetic powder is locally heated efficiently to a temperature near the melting point without raising a temperature inside the soft magnetic powder so much. Thereby, the oxide films of particles of the soft magnetic powder join diffusionally with one another, and the soft magnetic powder is unified as a sintered soft magnetic material.

Thus, if a millimeter wave sintering apparatus or a discharge plasma sintering apparatus is used in the sintering step, even if the oxide film on the surface of the soft magnetic powder is cracked in the press molding step before the sintering step, in the subsequent sintering step, when the oxide film on the surface of the soft magnetic powder is locally heated to a temperature near the melting point, the oxide film grows up again and the cracks in the oxide film are repaired. Accordingly, the insulation among particles of the soft magnetic powder can sufficiently be secured, and a sintered soft magnetic material having a low iron loss can be obtained.

In this case, as the cracks of the oxide film can be repaired in the sintering step, it is not necessary to form a thick oxide film. For example, even a thin oxide film having a thickness of several nanometers can secure a sufficient insulation between particles of the soft magnetic powder. Such a thinner oxide film can make a magnetic material more dense in the soft magnetic material, realize an increase in saturation magnetic flux density or magnetic permeability, and the improve magnetic properties. Moreover, the thinner oxide film enables a smaller particle size of the soft magnetic powder and, for example, the average particle diameter of the soft magnetic powder can be as small as 0.01 to 10 micrometers. The smaller particle size of the soft magnetic powder enables an increase in the strength of the soft magnetic material as shown clearly by the Hall-Petch Law mentioned below. Furthermore, the production process is comparatively simple and it excels in productivity.

In the present invention, as mentioned above, the sintering step of sintering using a millimeter wave sintering apparatus or a discharge plasma sintering apparatus may be carried out after the press molding step is completed, that is to say, press molding and sintering may be carried out separately. Alternatively, press molding and sintering may be carried out simultaneously, that is to say, while the molding compound of the soft magnetic powder is being press-molded into a predetermined shape, the press-molded soft magnetic powder may be sintered by elevating the temperature of the periphery of the oxide film up to near the melting point using a millimeter wave sintering apparatus or a discharge plasma sintering apparatus to produce a soft magnetic material. Like this, when carrying out press molding and sintering simultaneously, press molding can be carried out while the oxide film is growing by heating the periphery of the oxide film on the surface of the soft magnetic powder at a temperature near the melting point. Therefore, sintering can be carried out while preventing the oxide film from cracking or while restoring the start of cracks of the oxide film, and a sintered soft magnetic material having a low iron loss and a sufficient insulation among soft magnetic powder particles can be obtained. Moreover, when carrying out press molding and sintering simultaneously, the number of steps can be reduced and there is also an advantage that productivity can be improved.

In addition, in the surface oxidation step, the oxide film may be formed on the surface of the soft magnetic powder by heating the surface of the soft magnetic powder in an oxidizing atmosphere using a millimeter wave sintering apparatus or a discharge plasma sintering apparatus. That is to say, in a step of preparing a soft magnetic powder, the surface of the soft magnetic powder is oxidized a little, and in the surface oxidation process, if the soft magnetic powder is heated using a millimeter wave sintering apparatus or discharge plasma sintering apparatus, the energy of millimeter waves or discharge plasma will act locally on the oxidized surface portion, having a large electric resistance, of the soft magnetic powder, and the surface of the soft magnetic powder will be locally heated at an elevated temperature. Thereby, a thin oxide film having a thickness of several nanometers can be uniformly formed on the surface of the soft magnetic powder.

However, in the surface oxidation step, the oxide film may be formed on the surface of the soft magnetic powder using a heating means other than a millimeter wave sintering apparatus or discharge plasma sintering apparatus, for example, an electric furnace or the like. For example, the thickness of the oxide film can be controlled by ambient temperature or heating temperature, heating time, and the Al content or the Si content of the soft magnetic powder, when forming the oxide film using an electric furnace.

Preferably, the soft magnetic powder contains an Fe—Al alloy, an Fe—Al—Si alloy, an Fe—Si alloy, or Fe as a principal component. If a soft magnetic powder with an Fe—Al base, an Fe—Al—Si base or an Fe—Si base is heated, Al or Si having a more rapid oxidation rate than Fe will diffuse to the surface layer of the soft magnetic powder and oxidize, and the surface of the soft magnetic powder will be uniformly covered with an oxide of Al or Si. Therefore, if a soft magnetic powder with an Fe—Al base, an Fe—Al—Si base or an Fe—Si base is used, an oxide film can be formed on the surface of the soft magnetic powder efficiently. Moreover, if a powder of Fe is used, Fe on the surface of the powder will oxidize and an oxide film of iron oxide will be formed. Any oxide film of Al, Si, and Fe can fully secure the insulation between the powder particles.

Moreover, in the step of preparing a soft magnetic powder, a Cu base powder may be added to a raw material of the soft magnetic powder and the added raw material may be pulverized by a grinder. For example, if a Cu base powder is added to an Fe—Al base powder and is pulverized, an Fe—Al—Cu alloy layer will be formed partially on the powder surface. Then, in the subsequent surface oxidation step, the Fe—Al—Cu alloy layer oxidizes and an oxide film (FeAlCuO film) excellent in insulation and flexibility is formed.

Preferably, before the surface oxidation step, the soft magnetic powder may be heated in a reducing atmosphere to activate the surface of the soft magnetic powder. If it is done in this manner, an oxide film of good quality can be uniformly formed in a short time in the surface oxidation step. Furthermore, in a course of activating the surface of the soft magnetic powder, the soft magnetic powder is annealed by heating and it becomes softened. Thereby, in the press molding step, the soft magnetic powder becomes easy to deform so that voids among the soft magnetic powder particles may collapse, and a magnetic material in the soft magnetic materials can be made more dense.

Although the above-mentioned embodiments of the present invention comprise an indispensable requirement of using a millimeter wave sintering apparatus or a discharge plasma sintering apparatus in the sintering step, even when using a heating means other than a millimeter wave sintering apparatus or discharge plasma sintering apparatus, for example, electric furnace or the like in the sintering step, an oxide film may be formed by heating the surface of the soft magnetic powder in an oxidizing atmosphere using a millimeter wave sintering apparatus or a discharge plasma sintering apparatus in the surface oxidation step. If it is done in this manner, the soft magnetic powder surface can be locally heated at an elevated temperature, and a thin oxide film having a thickness of several nanometers can be uniformly formed on the surface of the soft magnetic powder.

EXAMPLES

Hereinafter, the best mode for carrying out the present invention will be illustrated using Examples 1 and 2.

Example 1

A method for producing a soft magnetic material in Example 1 of the present invention consists of a pulverization step, a surface activation step, a surface oxidation step, a binder blending step or molding compound preparation step, a press molding step, a binder removal step, and a sintering step carried out in order as shown in FIG. 1. Hereinafter, each of these steps is illustrated.

[Pulverization Step]

As a raw material of a soft magnetic powder, a metal containing either of an Fe—Al alloy, an Fe—Al—Si alloy, an Fe—Si alloy base, and Fe as a principal component is used. For example, an Fe—Al alloy preferably has a composition of 92.5 to 97.5 percents of Fe and 2.5 to 7.5 percents of Al. An Fe—Al—Si alloy preferably has a composition of 90 to 97 percent Fe, 3.5 to 6.5 percent Al, and 0.1 to 5 percent Si. Generally, the contents of Al and Si can be determined in consideration of the following three factors:

(1) In order to improve magnetic properties, lower contents of Al and Si are better.

(2) The contents of Al and Si should be within the solid solubility limit in which no intermetallic compound is formed.

(3) The thickness of the oxide film should be not less than a thickness by which a target value of electric resistance can be obtained.

In addition, a mixture of two or more of an Fe—Al alloy, an Fe—Al—Si alloy, an Fe—Si alloy, and Fe may be used.

Preferably 0.5 to 2 percent, more preferably about 1 percent of Cu base powder such as $Cu_2O$ may be added to the raw material of the soft magnetic powder. For example, if a Cu base powder is added to an Fe—Al base powder and is pulverized, an Fe—Al—Cu alloy layer will be formed partially on the surface of the Fe—Al base powder. Then, in the subsequent surface oxidation step, the Fe—Al—Cu alloy layer oxidizes to form an oxide film (FeAlCuO film) excellent in insulation and flexibility. In addition, metals added to the soft magnetic powder are not limited to a Cu base one. Other than Cu, any metal which can make an alloy with Fe and have higher insulation and flexibility than Fe may be used.

An attriter which can make a soft magnetic powder having an average particle diameter of not more than 100 micrometers can be used as a grinder. Highly active fracture surfaces are formed in surfaces of the soft magnetic powder by pulverizing using this attriter so that the average particle diameter of the soft magnetic powder may be 0.01 to 100 micrometers. In addition, the average particle diameter of the soft magnetic powder is more preferably 0.01 to 10 micrometers, still more preferably 0.01 to 5 micrometers, and most preferably 0.01 to 1 micrometer. A raw material of the soft magnetic powder which has not yet annealed should be used so that it may be easy to pulverize. During pulverization, a stainless steel container for pulverization may be cooled by water in order to prevent the temperature of the soft magnetic powder from rising by pulverization heat.

[Surface Activation Step]

$Cu_2O$, OH groups, and the like adhere to the surface of the soft magnetic powder pulverized by a grinder and the surface becomes inert. Therefore, a surface activation step is carried out after the pulverization step is completed. In the surface activation step, by heating the soft magnetic powder to about 800 degrees centigrade in a reducing atmosphere, $Cu_2O$, OH groups, and the like adhering to the powder surface are reduced and the surface of the soft magnetic powder is activated, and also the soft magnetic powder is annealed and is softened. Thereby, in the press molding step mentioned below, the soft magnetic powder becomes easy to deform so that voids among the soft magnetic powder particles may collapse, and a magnetic material in the soft magnetic material can be made more dense.

In the surface activation step, as the inside of the soft magnetic powder must be heated in order to anneal the soft magnetic powder, common heating furnaces, such as an electric furnace, should just be used as a means to heat the soft magnetic powder.

[Surface Oxidation Step]

A surface oxidation step is carried out after the surface activation step is completed. In the surface oxidation step, an oxide film is formed on the surface of the soft magnetic powder by heating the surface of the soft magnetic powder locally to about 800 degrees centigrade in an oxidizing atmosphere, for example, under an $O_2$ ambient atmosphere, using a millimeter wave sintering apparatus as a heating means.

Figure 2:
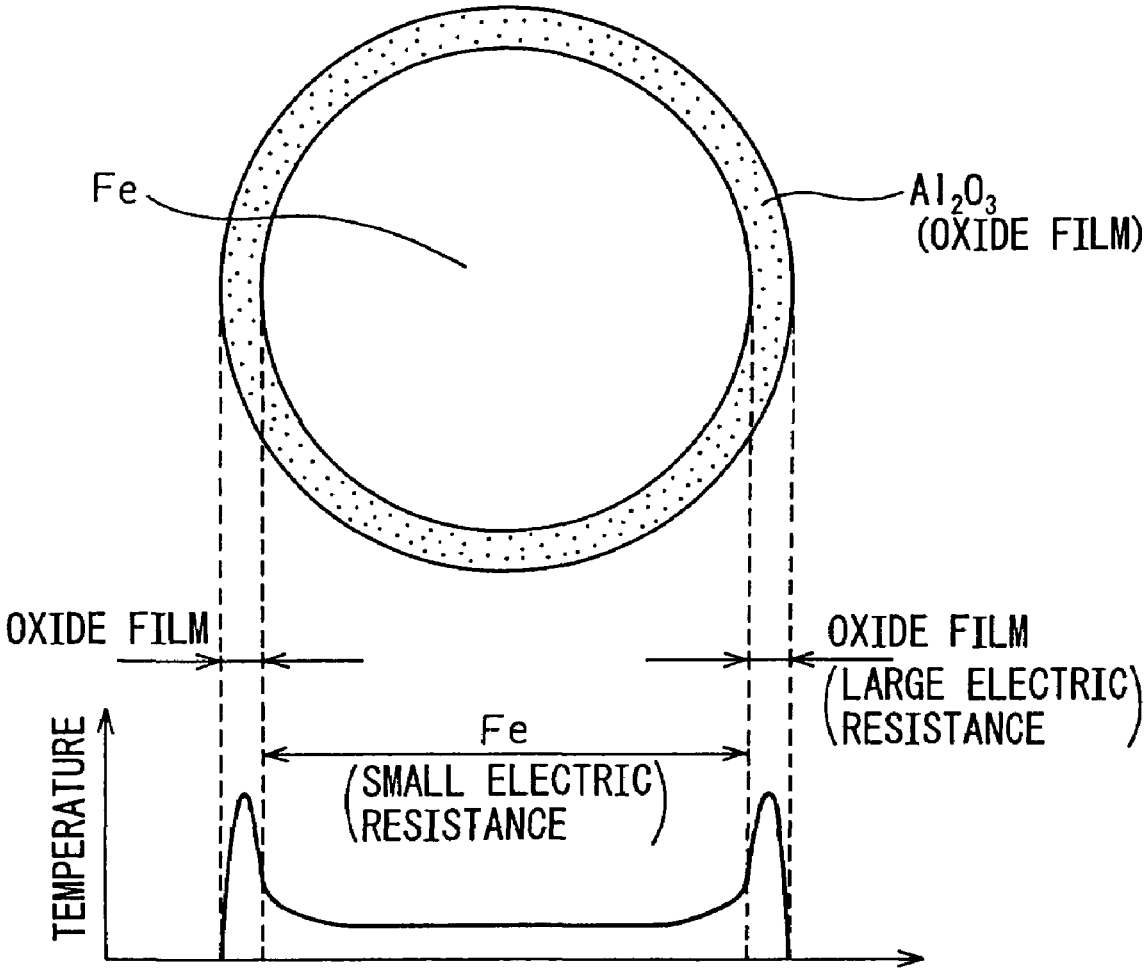
FIG. 2 illustrates the surface oxidation treatment of an Fe—Al base powder.

As the surface of the soft magnetic powder generally oxidizes a little in the pulverization step of preparing a soft magnetic powder, if a millimeter wave sintering apparatus is used in the surface oxidation step, the energy of millimeter waves radiated from the millimeter wave sintering apparatus will act locally on the oxidized surface portion having a large electric resistance of the soft magnetic powder, and the surface of the soft magnetic powder will be locally heated at an elevated temperature. Refer to FIG. 2. Thereby, a thin oxide film having a thickness of several nanometers is uniformly formed on the surface of the soft magnetic powder. At this time, the thickness of the oxide film can be controlled by the millimeter wave conditions and the content of Al and Si.

If the surface of the soft magnetic powder is heated to about 800 degrees centigrade using a millimeter wave sintering apparatus when a soft magnetic powder with Fe—Al or Fe—Al—Si base is used, Al or Si having a more rapid oxidation rate than Fe will diffuse to the surface layer of the soft magnetic powder and oxidize, and the surface of the soft magnetic powder will be uniformly covered with an oxide of Al or Si. Refer to FIG. 2. When the soft magnetic powder consists of Fe, Fe at the surface of the powder oxidizes and an oxide film of iron oxide is formed.

Moreover, when using an Fe—Al base powder with a Cu base powder added as a soft magnetic powder, an Fe—Al—Cu alloy layer is formed partially on the surface of the Fe—Al base powder in the pulverization step. Therefore, in the surface oxidation step, the Fe—Al—Cu alloy layer oxidizes to form an FeAlCuO film excellent in insulation and flexibility.

When a soft magnetic powder is heated using a discharge plasma sintering apparatus instead of a millimeter wave sintering apparatus in the surface oxidation step, the energy of discharge plasma acts locally on the oxidized surface portion having a large electric resistance of the soft magnetic powder, and the soft magnetic powder surface is locally heated at an elevated temperature, whereby a thin oxide film having a thickness of several nanometers is uniformly formed on the surface of the soft magnetic powder.

[Molding Compound Preparation Step]

A molding compound preparation step is carried out after the surface oxidation step is completed. In the molding compound preparation step, the soft magnetic powder is blended with a solution of a binder and a solvent, and then it is fully kneaded to prepare a molding compound of the soft magnetic powder. As a binder, camphor, having high tackiness and a slipping property is preferably used for densification. Organic solvents, such as acetone, can be used as a solvent.

[Press Molding Step]

A press molding step is carried out after the molding compound preparation step is completed. In the press molding step, the molding compound of the soft magnetic powder is injected into a die, and is press-molded into a predetermined shape. The press pressure may be, for example, 980 Pa (10 ton/cm$^2$).

[Binder Removal Step]

After the press molding step is completed, a binder removal step is carried out, in which the press-molded soft magnetic powder is heated at about 50 to 100 degrees centigrade in an electric furnace or the like, and a binder and a solvent in the press-molded soft magnetic powder are vaporized, or evaporated, and are removed.

[Sintering Step]

A sintering step is carried out after the binder removal step is completed. In the sintering step, a millimeter wave sintering apparatus is used as a heating means as well as in the surface oxidation step. In the sintering step, the press-molded soft magnetic powder is heated so that the temperature of the periphery of the oxide film on the surface of the soft magnetic powder may rise to about 1200 to 1300 degrees centigrade, and near the melting point, in a reducing atmosphere and, for example, under an $N_2$ ambient atmosphere. During the sintering step, the energy of millimeter waves radiated from the millimeter wave sintering apparatus acts locally on the periphery of the oxide film having a large electric resistance on the surface of the soft magnetic powder. Thereby, only the periphery of the oxide film on the surface of the soft magnetic powder is locally heated efficiently to a temperature near the melting point (in detail, at or below the melting point) without raising the temperature inside the soft magnetic powder as much. Thereby, the oxide films of particles of the soft magnetic powder join diffusionally with one another, and the soft magnetic powder is unified as a sintered soft magnetic material.

A millimeter wave often refers generally to one having a frequency in a range of 10 to 300 GHz (a wave having a frequency in a range of 10 to 30 GHz is referred to as a submillimeter wave). However, in Example 1, in order to efficiently raise the temperature of the periphery of the oxide film to near the melting point, the press-molded soft magnetic powder is sintered using a millimeter wave sintering apparatus which generates millimeter waves having a frequency in a range of 10 to 300 GHz.

In this case, as a millimeter wave sintering apparatus is used in the sintering step, even if the oxide film on the surface of the soft magnetic powder is cracked in the press molding step before the sintering step, when the oxide film on the surface of the soft magnetic powder is locally heated to a temperature near the melting point in the subsequent sintering step, the oxide film grows again and the cracks of the oxide film are repaired. Thereby, the insulation between particles of the soft magnetic powder can be sufficiently secured, and a sintered soft magnetic material having a low iron loss can be obtained.

When a soft magnetic powder is heated using a discharge plasma sintering apparatus instead of a millimeter wave sintering apparatus in the sintering step, the energy of discharge plasma acts locally on the oxide film on the surface of the soft magnetic powder and the oxide film is locally heated to a temperature near the melting point, whereby the cracks of the oxide film can be repaired.

A soft magnetic material produced by a method for producing a soft magnetic material of Example 1 illustrated above can be used as soft magnetic parts of various kinds of electromagnetic drive devices such as an electromagnetic drive valve of an internal combustion engine.

As a millimeter wave sintering apparatus or a discharge plasma sintering apparatus was used as a heating means in the sintering step in the method for producing a soft magnetic material of Example 1, even if the oxide film on the surface of the soft magnetic powder is cracked in the press molding step before the sintering step, sintering can be carried out while repairing the cracks of the oxide film by heating the oxide film on the surface of the soft magnetic powder locally to a temperature near the melting point in the subsequent sintering step. Thereby, the insulation among particles of the soft magnetic powder can sufficiently be secured, and a sintered soft magnetic material having a low iron loss can be obtained.

In this case, as the cracks of the oxide film can be repaired in the sintering step, it is not necessary to form a thick oxide film and the insulation between particles of the soft magnetic powder can sufficiently be secured even if the oxide film is as thin as several nanometers. Such a thin oxide film can make a magnetic material in the soft magnetic material denser, realize an increase in saturation magnetic flux density or magnetic permeability, and improve magnetic properties. Moreover, the thinner oxide film enables a smaller particle size of the soft magnetic powder and, for example, the average particle diameter of the soft magnetic powder can be as small as 0.01 to 10 micrometers, more preferably 0.01 to 5 micrometers. The smaller particle size of the soft magnetic powder enables increase in strength of the soft magnetic material as shown clearly by the Hall-Petch Law mentioned below.

$$\text{Hall-Petch Law: } \sigma_y = \sigma_o + k \cdot d^{-1/2}$$

wherein $\sigma_y$ denotes a yield stress, $\sigma_o$ denotes the minimum yield stress, k denotes a constant, and d denotes the particle size of a soft magnetic powder.

As shown clearly by the Hall-Petch Law mentioned above, the smaller a soft magnetic powder particle size d is, the larger a yield stress $\sigma_y$ is. Therefore, a soft magnetic material can be strengthened by making the particle size of the soft magnetic powder small.

Moreover, in Example 1, by paying attention to the point that the surface of the soft magnetic powder oxidizes a little in the step of pulverizing a soft magnetic powder, the surface of the soft magnetic powder was heated using a millimeter wave sintering apparatus or a discharge plasma sintering apparatus in the surface oxidation step. Therefore, there are also advantages that the energy of the millimeter waves or discharge plasma can act locally on the oxidized surface portion having a large electric resistance of the soft magnetic powder, the surface of the soft magnetic powder can be locally heated at an elevated high temperature, and a thin oxide film having a thickness of several nanometers can be uniformly formed on the surface of the soft magnetic powder.

However, in the surface oxidation step, the oxide film may be formed on the surface of the soft magnetic powder using a heating means other than a millimeter wave sintering apparatus or discharge plasma sintering apparatus such as, for example, an electric furnace or the like. For example, the thickness of the oxide film can be controlled by ambient temperature or heating temperature, heating time, an Al content or an Si content of the soft magnetic powder when forming the oxide film using an electric furnace.

Moreover, even when using a heating means other than a millimeter wave sintering apparatus or discharge plasma sintering apparatus such as, for example, electric furnace or the like in the sintering step, an oxide film may be formed by heating the surface of the soft magnetic powder in an oxidizing atmosphere using a millimeter wave sintering apparatus or a discharge plasma sintering apparatus in the surface oxidation step. If heating is done in this manner, the surface of the soft magnetic powder can be locally heated at a temperature near the melting point, and a thin oxide film having a thickness of several nanometers can be uniformly formed on the surface of the soft magnetic powder.

Besides, a binder was blended when the molding compound of a soft magnetic powder was prepared in Example 1, but the molding compound may be prepared without blending a binder.

Example 2

Figure 3:
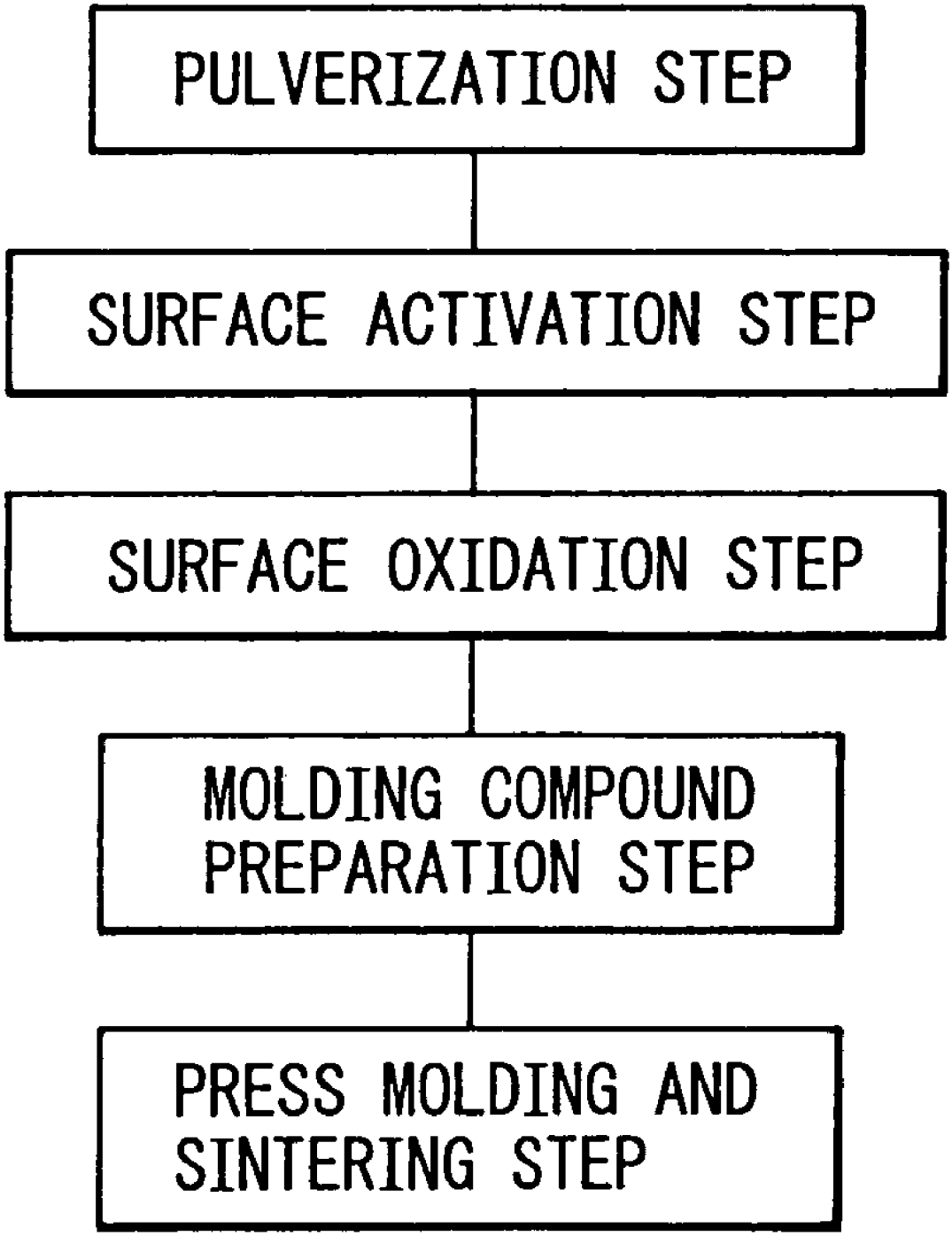
FIG. 3 is a process flow chart illustrating a production process of a soft magnetic material in Example 2 of the present invention.

In Example 1 mentioned above, the sintering step was carried out using a millimeter wave sintering apparatus after the press molding step was completed, that is to say, the press molding step and the sintering step were carried out separately. In Example 2 shown in FIG. 3, however, a press molding and sintering step was carried out after a molding compound of the soft magnetic powder was prepared by the same manner as in Example 1. Press molding and sintering were carried out simultaneously in the press molding and sintering step, in which the press-molded soft magnetic powder was sintered by elevating the temperature of the periphery of the oxide film to near the melting point using a millimeter wave sintering apparatus or a discharge plasma sintering apparatus while press-molding the molding compound of the soft magnetic powder into a predetermined shape to-produce a soft magnetic material.

When carrying out press molding and sintering simultaneously, press molding can be carried out, while the oxide film is growing, by heating the periphery of the oxide film on the surface of the soft magnetic powder to a temperature near the melting point. Therefore, sintering can be carried out while preventing the oxide film from cracking or while repairing the cracks in the oxide film, and a sintered soft magnetic material having a low iron loss and a sufficient insulation between soft magnetic powder particles can be obtained. Moreover, when carrying out press molding and sintering simultaneously, there are also advantages that the number of steps can be reduced and the productivity can be improved.

What is claimed is:

1. A method for producing a soft magnetic material, comprising:

a surface oxidation step of forming oxide films on the surfaces of a soft magnetic powder, a step of preparing a molding compound of the soft magnetic powder for press-molding the soft magnetic powder, a press molding step of press-molding the molding compound of the soft magnetic powder into a predetermined shape, and a sintering step of sintering the press-molded soft magnetic powder by elevating the temperature of the periphery of the oxide film to near the melting point using a millimeter wave sintering apparatus or a discharge plasma sintering apparatus to produce a soft magnetic material, wherein a Cu base powder is added to a raw material of the soft magnetic powder and the added raw material is pulverized by a grinder in a step of preparing the soft magnetic powder.

2. A method for producing a soft magnetic material according to claim 1, which further comprises a step of heating a soft magnetic powder in a reducing atmosphere to activate the surfaces of the soft magnetic powder before the surface oxidation step.

3. A method for producing a soft magnetic material according to claim 1, wherein, in the surface oxidation step, the oxide film is formed on the surfaces of the soft magnetic powder by heating the surfaces of the soft magnetic powder in an oxidizing atmosphere using a millimeter wave sintering apparatus or a discharge plasma sintering apparatus.

4. A method for producing a soft magnetic material according to claim 1, wherein the soft magnetic powder has an average particle diameter of 0.01 to 10 micrometers.

5. A method for producing a soft magnetic material according to claim 1, wherein the soft magnetic powder contains a Fe—Al alloy, a Fe—Al—Si alloy, a Fe—Si alloy, or Fe as a principal component.

6. A method for producing a soft magnetic material according to claim 1, wherein 0.5 to 2 percent of the Cu base powder is added to the raw material of the soft magnetic powder.

7. A method for producing a soft magnetic material according to claim 1, wherein the soft magnetic powder has an average particle diameter of 0.01 to 1 micrometers.

8. A method for producing a soft magnetic material, comprising:

a surface oxidation step of forming oxide films on the surfaces of a soft magnetic powder, a step of preparing a molding compound of the soft magnetic powder for press-molding the soft magnetic powder, a press molding and sintering step of sintering a press-molded soft magnetic powder by elevating the temperature of the periphery of the oxide film to near the melting point using a millimeter wave sintering apparatus or a discharge plasma sintering apparatus while press-molding the molding compound of the soft magnetic powder into a predetermined shape to produce a soft magnetic material, wherein a Cu base powder is added to a raw material of the soft magnetic powder and the added raw material is pulverized by a grinder in a step of preparing the soft magnetic powder.

9. A method for producing a soft magnetic material according to claim 8, which further comprises a step of heating a soft magnetic powder in a reducing atmosphere to activate the surfaces of the soft magnetic powder before the surface oxidation step.

10. A method for producing a soft magnetic material according to claim 8, wherein, in the surface oxidation step, the oxide film is formed on the surfaces of the soft magnetic powder by heating the surfaces of the soft magnetic powder in an oxidizing atmosphere using a millimeter wave sintering apparatus or a discharge plasma sintering apparatus.

11. A method for producing a soft magnetic material according to claim 8, wherein the soft magnetic powder has an average particle diameter of 0.01 to 10 micrometers.

12. A method for producing a soft magnetic material according to claim 8, wherein the soft magnetic powder contains a Fe—Al alloy, a Fe—Al—Si alloy, a Fe—Si alloy, or Fe as a principal component.

13. A method for producing a soft magnetic material according to claim 8, wherein 0.5 to 2 percent of the Cu base powder is added to the raw material of the soft magnetic powder.

14. A method for producing a soft magnetic material according to claim 8, wherein the soft magnetic powder has an average particle diameter of 0.01 to 1 micrometers.

15. A method for producing a soft magnetic material comprising:

a surface oxidation step of forming oxide films on the surfaces of a soft magnetic powder;

a step of preparing a molding compound of the soft magnetic powder for press-molding the soft magnetic powder;

a press molding step of press-molding the molding compound of the soft magnetic powder into a predetermined shape; and a sintering step of sintering the press-molded soft magnetic powder to produce a soft magnetic material, characterized by:

forming oxide films having a thickness of several nanometers on the surfaces of the soft magnetic powder by locally heating only the oxidized portion produced on the surfaces of the soft magnetic powder during the preparation of the powder, in an oxidizing atmosphere, to a temperature at which an oxide film is formed, and using a millimeter wave sintering apparatus or a discharge plasma sintering apparatus in the surface oxidation step.

16. A method for producing a soft magnetic material according to claim 15, wherein, in the surface oxidation step, the oxide film is formed on the surfaces of the soft magnetic powder by heating the surfaces of the soft magnetic powder is an oxidizing atmosphere using a millimeter wave sintering apparatus or a discharge plasma sintering apparatus.

17. A method for producing a soft magnetic material according to claim 15, wherein the soft magnetic powder has an average particle diameter of 0.01 to 10 micrometers.

18. A method for producing a soft magnetic material according to claim 15, wherein the soft magnetic powder contains a Fe—Al alloy, a Fe—Al—Si alloy, a Fe—Si alloy, or Fe as a principal component.

19. A method for producing a soft magnetic material according to claim 15, wherein a Cu base powder is added to a raw material of the soft magnetic powder and the added raw material is pulverized by a grinder in a step of preparing the soft magnetic powder.

20. A method for producing a soft magnetic material according to claim 15, which further comprises a step of heating a soft magnetic powder in a reducing atmosphere to activate the surfaces of the soft magnetic powder before the surface oxidation step.

* * * * *